United States Patent [19]

Ayub

[11] Patent Number: 4,932,468

[45] Date of Patent: Jun. 12, 1990

[54] VERTICAL FALLING FILM MULTI-TUBE HEAT EXCHANGER

[75] Inventor: Zahid H. Ayub, Constantine, Mich.

[73] Assignee: E. L. Nickell Co., Inc., Constantine, Mich.

[21] Appl. No.: 286,418

[22] Filed: Dec. 19, 1988

[51] Int. Cl.[5] ..... F28D 5/02; F28F 9/22

[52] U.S. Cl. ..... 165/118; 165/115; 165/174; 261/153; 159/13.2; 159/43.1

[58] Field of Search ..... 165/115, 118, 174; 261/153; 159/13.2, 43.1; 202/236

[56] References Cited

U.S. PATENT DOCUMENTS

| | | | |
|---|---|---|---|
| 1,522,366 | 1/1925 | Hiller | 159/13.2 |
| 1,557,838 | 10/1925 | Hiller | 159/13.2 |
| 1,631,162 | 6/1927 | Sebald | 159/13.2 |
| 3,016,067 | 1/1962 | Edmonds | 138/38 |
| 3,370,635 | 2/1968 | Kumm | 159/13.2 |
| 3,412,778 | 11/1968 | Witt et al. | 165/115 |
| 3,437,124 | 4/1969 | Bryan et al. | 159/13 |
| 3,502,140 | 3/1970 | Dawson | 165/117 |
| 4,133,377 | 1/1979 | de Lallee et al. | 165/118 |
| 4,199,537 | 4/1980 | Zardi et al. | 165/174 |
| 4,248,296 | 2/1981 | Jezek | 165/118 |
| 4,469,169 | 9/1984 | Kotwica | 165/174 |
| 4,788,020 | 11/1988 | Yampolsky et al. | 261/153 |

FOREIGN PATENT DOCUMENTS

| | | | |
|---|---|---|---|
| 46-14508 | 4/1971 | Japan | 165/115 |
| 1287401 | 12/1986 | Japan | 159/13.2 |
| 0816474 | 4/1981 | U.S.S.R. | 159/13.2 |
| 1134210 | 1/1985 | U.S.S.R. | 159/13.2 |
| 1249292 | 8/1986 | U.S.S.R. | 165/118 |

*Primary Examiner*—John Ford

*Attorney, Agent, or Firm*—Jeffers, Hoffman & Niewyk

[57] ABSTRACT

A heat exchanger with a multiplicity of generally vertical heat transfer tubes has an improved liquid distribution arrangement in its upper inlet head. The liquid distribution arrangement includes a flow diverting baffle disposed within the inlet head above the tubes, a plurality of flow restricting devices inserted in the upper open ends of the tubes and a dam spaced inwardly from a peripheral region of the upper head for receiving flow from the baffle and providing an overflow reservoir surrounding the upper open tube ends for evenly distributing flow to the upper open tube ends.

30 Claims, 5 Drawing Sheets

VERTICAL FALLING FILM MULTI-TUBE HEAT EXCHANGER

BACKGROUND OF THE INVENTION

The present invention generally relates to equipment for cooling a liquid and, more particularly, is concerned with a vertical multi-tube falling film type heat exchanger having an arrangement for providing improved liquid distribution at an inlet head of the heat exchanger.

Various types of heat exchangers have been used for cooling liquids. One type called a vertical falling film heat exchanger has an outer shell in which are disposed a plurality of vertical tubes in a side-by-side spaced array extending between and connected at their opposite ends to tube sheets attached across top and bottom ends of the shell.

Also, the heat exchanger has upper and lower hemispherical shaped heads attached to the upper and lower tube sheets to define flow manifolds which communicate with opposite open ends of the tubes respectively above and below the tube sheets at the top and bottom ends of the outer shell. An inlet is attached to the upper head and an outlet is attached to the lower head. The liquid to be chilled or cooled flows from the inlet, through the upper head, to and through the interiors of the vertical tubes, from the tubes into the lower head, and out the outlet.

Further, the outer shell of the heat exchanger has a lower inlet and an upper outlet for circulation of a refrigerant, such as ammonia, through the outer shell upwardly along the exteriors of the vertical tubes. To cool the liquid, heat must transfer from the liquid flowing downward within the tubes, through the walls of the tubes, to the refrigerant flowing upward along the exteriors of the tube walls. In order to provide for rapid chilling of the liquid, it is necessary that the liquid flow in a thin film on the inner surface of the tubes. As can be appreciated, this will cause the liquid to quickly give off its heat to the refrigerant in the outer shell and achieve the desired temperature with a single pass through the heat exchanger.

In one application of the heat exchanger in the beverage industry, the requirement is to cool or chill a liquid, such as water, from approximately 70° F. to 80° F. at the heat exchanger inlet down to about 34° F. at its outlet. However, difficulties have been encountered in lowering the temperature of the water below around 40° F.

One cause of the difficulties is inadequate distribution of the liquid, such as water, to all of the tubes. If the liquid is not distributed evenly, then some tubes will be flooded with liquid, others partially flooded with liquid, and still others starved of liquid, resulting in suboptimal heat transfer. Another cause is inadequate control of liquid flow into and down the tubes. Some of the liquid falls through the tubes without contacting the tube walls and so does not flow as a thin film down the interior of the tube walls which would optimize the transfer of heat from the liquid to the refrigerant.

Another type of known heat exchanger is the plate-type heat exchanger which comprises a large number of corrugated sheets or plates that are gasketed together.

SUMMARY OF THE INVENTION

The present invention provides a liquid distribution arrangement designed to satisfy the aforementioned needs. The distribution arrangement of the present invention incorporates several features which eliminate the above-described causes of the difficulties and improve the overall operating efficiency and reliability of the heat exchanger. In particular, the distribution arrangement of the present invention provides a more even distribution of liquid to the multiplicity of vertical heat exchanger tubes and better control of water flow so as to produce a flowing film of water through the tubes on the interiors of the walls thereof. The heat exchanger incorporating the liquid distribution arrangement of the present invention is capable of reduction of water temperature from 80° F. down to 34° F. with no freeze-up, using 30° F. refrigerant, such as required in the beverage industry.

With the heat exchanger according to the present invention, greater efficiency is realized thereby enabling the overall size of the heat exchanger to be smaller. Furthermore, the interior of the heat exchanger is easily accessible for cleaning and that access can be gained merely by moving one of the heads.

The liquid chiller of the present invention can be manufactured at a lower cost due to its smaller size, and the operating cost is also lower because of the fact that a frost condition need not be attained, as is the case with plate-type heat exchangers.

Better gasketing can be accomplished with the design according to the present invention, thereby enabling higher operating pressures.

Accordingly, the present invention is directed to a liquid distribution arrangement in a heat exchanger. The heat exchanger has an upper generally horizontal tube sheet, a multiplicity of generally vertical heat transfer tubes attached at their open upper ends to the upper tube sheet, and an upper head having an inlet spaced above the upper tube sheet, the upper head being attached to the upper tube sheet to define a cavity therewith which communicates between the inlet and the ends of the tubes opening above the upper tube sheet so as to allow direct flow of liquid from the inlet downwardly through the cavity to at least some of the open ends of the tubes. The improved liquid distribution arrangement comprises, in one form of the invention, a baffle; and means for supporting the baffle in the cavity below the inlet and above the open ends of the tubes; the baffle having means for receiving flow of liquid from the inlet and diverting the liquid flow radially outward to an annular interior perimeter region of the upper head surrounding the open ends of the tubes from which the liquid can then flow inward to the open tube ends such that the liquid is prevented from flowing directly downwardly through the cavity from the inlet to the open tube ends.

More particularly, the flow receiving and diverting means of the baffle is a top wall and a side wall depending from an outer periphery of the top wall. Preferably, the top and side walls of the baffle have a frusto-conical shape in axial cross-section.

Further, the baffle supporting means may include a plurality of vent members extending between and interconnecting the baffle and the upper head. The vent members provide flow communication between the exterior of the upper head and a region of the cavity beneath the baffle and above the open tube ends to equalize pressure in the exchanger. Also, the baffle supporting means includes a plurality of support legs extending between and interconnecting the baffle and the inlet of the upper head.

The liquid distribution arrangement may further comprise a plurality of liquid flow restricting devices. Each device has lower and upper portions. The lower portion of each device is inserted within one of the open tube ends and has means for causing a swirling rotation of the liquid as it flows into the one open tube end to produce a flowing film of liquid through the tube on an interior wall surface thereof. The upper portion of each device extends upwardly from the one open tube end and into the region of the cavity located beneath the baffle. Also, the upper portion has a passage which vents the interiors of the tubes.

The liquid distribution arrangement, in one form of the invention, also comprises means defining a dam spaced inwardly from the periphery of the upper head such that the annular interior perimeter region of the upper head is located therebetween for receiving flow from the baffle and providing an overflow reservoir surrounding the upper open tube ends for evenly distributing flow to the upper open tube ends. A series of orifices are provided in the bottom of the dam defining means to permit draining of the reservoir during periods of non-use.

To further enhance the flow distribution of the liquid down the interior of the tubes, expansion springs can be inserted in the tubes at predetermined elevations. If desired, the tubes can be provided with spiral fluted sections, both on the interior and exterior of the tube, which results in more uniform flow of the film down the inside wall of the tube. The exterior flutes are advantageous in that they enhance heat transfer by creating discontinuities that provide nucleate boiling sites for the refrigerant.

These and other features and advantages on the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
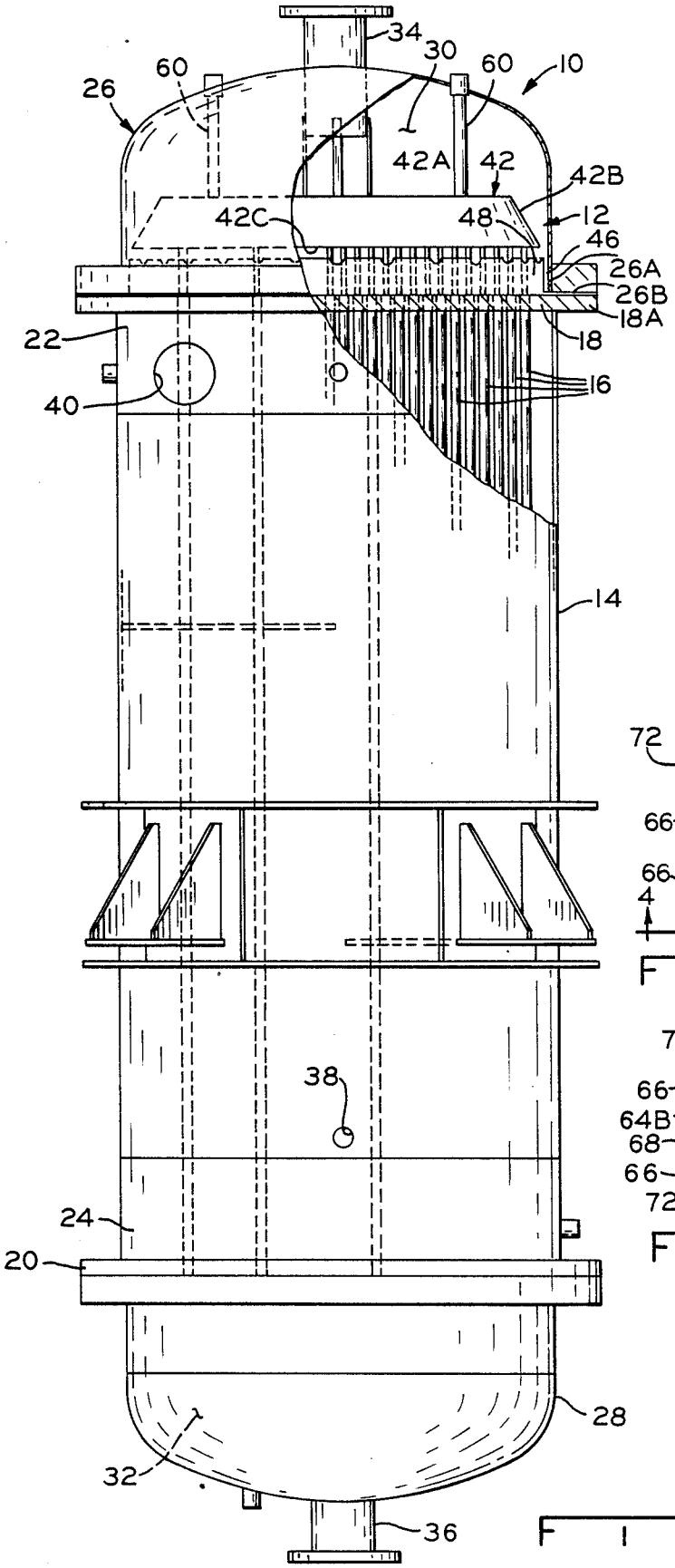
FIG. 1 is an elevational view, with portions broken away, of a vertical, single-pass, multi-tube, falling film heat exchanger having a liquid distribution arrangement employing features of the present invention.
Figure 3:
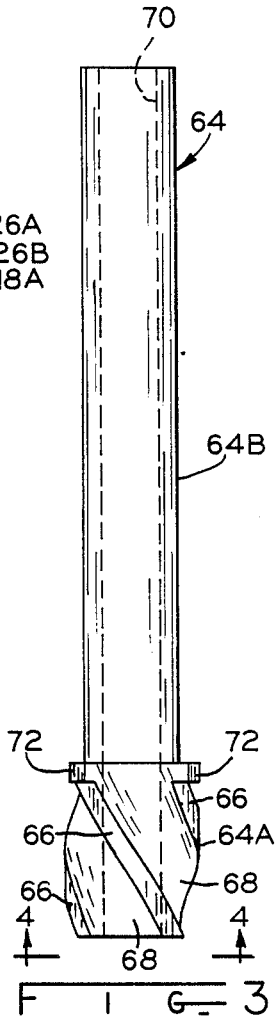
FIG. 3 is an enlarged elevational view of one of a plurality of flow restricting devices employed in the liquid distribution arrangement of FIG. 1.
Figure 4:
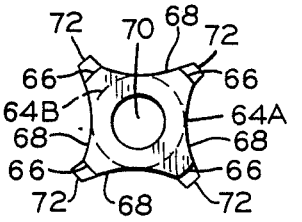
FIG. 4 is a bottom plan view of the flow restricting device as seen along line 4—4 of FIG. 3.
Figure 2:
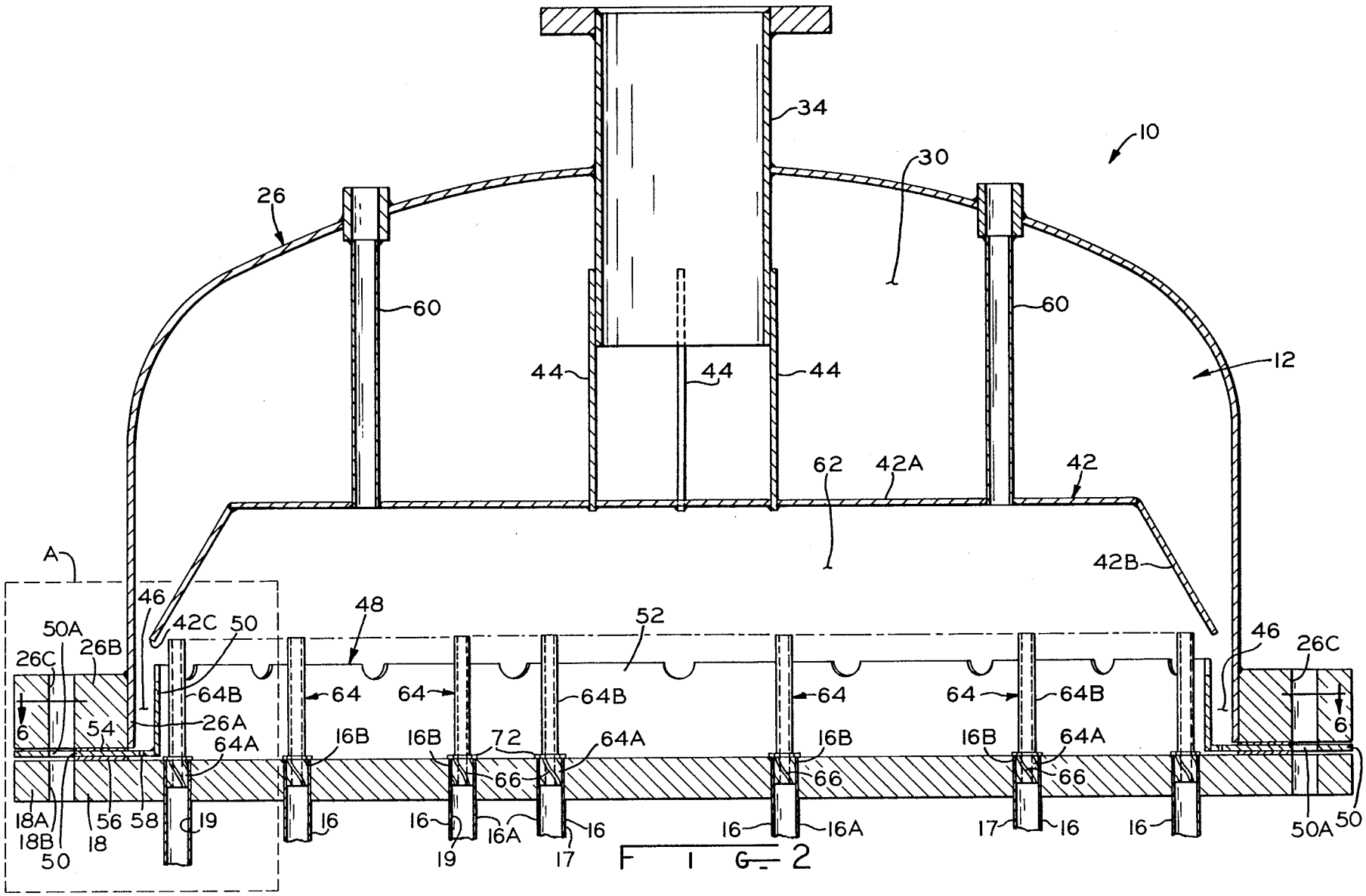
FIG. 2 is an enlarged longitudinal axial sectional view of an inlet head of the heat exchanger of FIG. 1 illustrating the liquid distribution arrangement.
Figure 6:
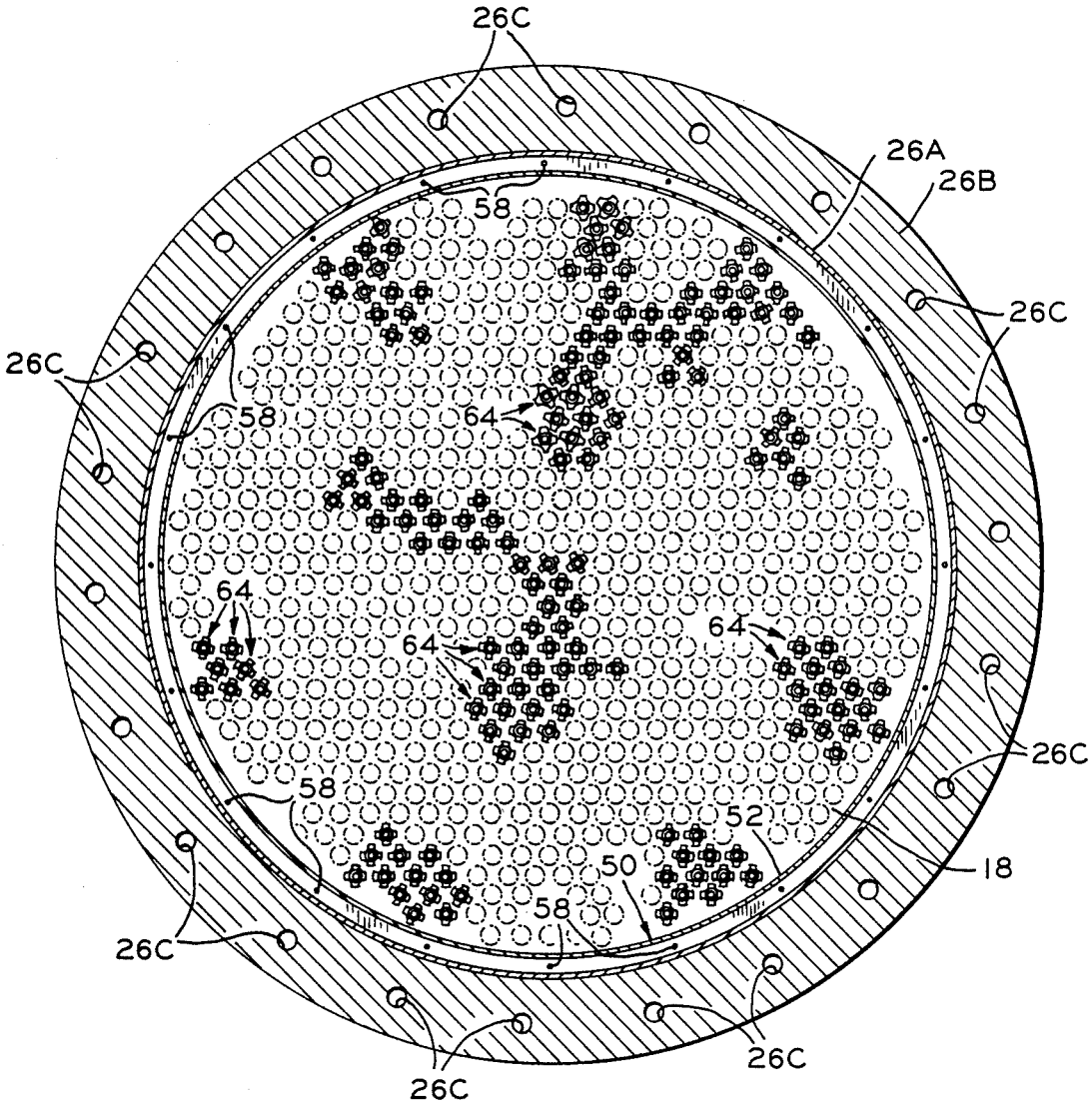
FIG. 6 is a reduced cross-sectional view taken along line 606 of FIG. 2 illustrating a portion of the liquid distribution arrangement of the heat exchanger.

Referring now to the drawings, and particularly to FIGS. 1, 2 and 6, there is shown a vertical, single-pass, multi-tube, falling film type heat exchanger, generally designated by the numeral 10, which incorporates an improved liquid distribution arrangement, generally indicated 12 and constructed in accordance with the principles of the present invention. The heat exchanger 10 is particularly suited for cooling or chilling a liquid, such as water, for use in the beverage industry. However, the heat exchanger 10 can be employed in many other applications.

In addition to the liquid distribution arrangement 12, the heat exchanger 10 includes a vertically-extending outer shell 14 and a plurality of vertical heat transfer tubes 16 disposed in a side-by-side spaced array and extending between and connected at their opposite ends to horizontally-extending upper and lower tube sheets 18, 20. The tube sheets 18, 20 are attached respectively across top and bottom ends 22, 24 of the shell 14.

The heat exchanger 10 also includes a pair of upper and lower hemispherical shaped heads 26, 28 respectively attached to the upper and lower tube sheets 18, 20. The upper and lower heads 26, 28 define top and bottom flow manifolds or cavities 30, 32 which communicate with opposite open ends of the heat transfer tubes 16 respectively above and below the upper and lower tube sheets 18, 20 at the top and bottom ends 22, 24 of the outer shell 14.

Also, the heat exchanger 20 has a top inlet 34 attached to the upper head 26 and a bottom outlet 36 attached to the lower head 28. The liquid to be chilled or cooled flows from the top inlet 34, through the upper head 26, to and through the interiors of the vertical heat transfer tubes 16, from the tubes 16 into the lower head 28, and out the bottom inlet 36.

Further, the outer shell 14 of the heat exchanger 10 has lower inlets 38 and upper outlets 40 for circulation of a refrigerant, such as ammonia, through the outer shell 14 upwardly along the exteriors of the vertical heat transfer tubes 16. To cool the liquid, heat must transfer from the liquid flowing downward within the tubes 16, through the walls 16A of the tubes 16, to the refrigerant flowing upward along the exteriors 17 of the tube walls 16A.

The liquid distribution arrangement 12 allows the heat exchanger 10 to cool or chill liquid by the required amount, for example, from approximately 70° F. to 80° F. at the heat exchanger top inlet 34 down to about 34° F. at its bottom outlet 36. The achievement of the required temperature drop is brought about by even distribution of water to the vertical heat transfer tubes 16 and the control or restriction of water passage through the tubes 16 as a thin film F (FIG. 5) flowing down the interiors 19 of the walls 16A of the tubes 16. Such distribution and control more nearly tends to optimize the transfer of heat from the water to the refrigerant.

In one of its improved features best shown in FIGS. 1 and 2, the liquid distribution arrangement 12 includes a flow diverting cavity 30 below the top inlet 34 on the upper head 26 and above the open ends 16B of the heat transfer tubes 16. The baffle 42 has a generally flat horizontal circular top wall 42A and a generally downwardly and outwardly declining annular side wall 42B depending from an outer periphery of the top wall 42A. Preferably, the baffle top and side walls 42A, 42B together have a frusto-conical shape in axial cross-section which promotes the desired liquid flow pattern. Also, the baffle supporting means 44 are a plurality of spaced support legs which extend vertically between and interconnect the baffle 42 and the top inlet 34 of the upper head 26.

Figure 5:
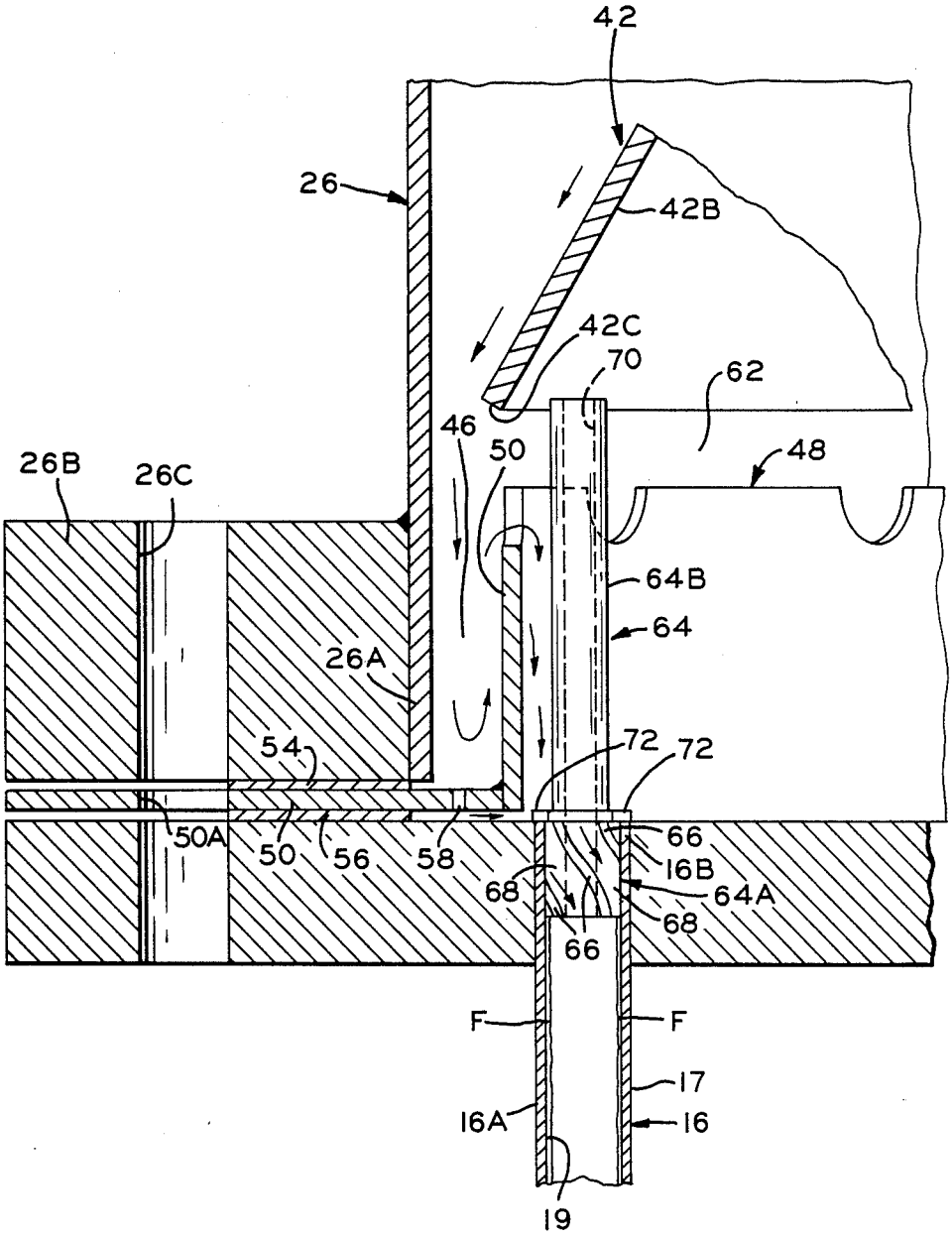
FIG. 5 is an enlarged view of a fragmentary portion of the inlet head of the heat exchanger enclosed by the dashed square identified by the letter A in FIG. 2.

Specifically, the baffle 42 is disposed for receiving flow of liquid from the top inlet 34 and diverting the liquid flow radially outward to an annular interior perimeter region 46, best seen in FIGS. 2 and 5, of the upper head 26 surrounding the open ends 16B of the heat transfer tubes 16. From the region 46, the liquid can then flow inward to the open tube ends 16B after overflowing another feature described below. The baffle 42 thus prevents the liquid from flowing directly downwardly through the top cavity 30 from the top inlet 34 to the open tube ends 16B.

In another of its improved features seen in FIGS. 1, 2 and 5, the liquid distribution arrangement 12 includes a dam 48 spaced inwardly from the lower periphery 26A of the upper head 26. The annular interior perimeter region 46 along the interior of the upper head 26 is located between the dam 48 and the upper head lower periphery 26A for receiving flow of liquid from the lower edge 42C of the baffle side wall 42B and providing an overflow reservoir 46 surrounding the upper open tube ends 16B for evenly distributing flow to the upper open tube ends.

The dam 48 is constructed of an annular generally horizontal flange 50 and an upstanding annular wall 52. The flange 50 extends radially outward from the wall 52 and defines a bottom of reservoir 46. The outer periphery of the flange 50 is disposed between and connected to peripheral rims 26B, 18A of the upper head 26 and the upper tube sheet 18 by fasteners (not shown) inserted through sets of aligned holes 26C, 18B, 50A of the rims 26B, 18A and flange 50 which are spaced circumferentially from one another, as shown in FIG. 6. The upstanding annular wall 52 of the dam 48 is attached at its lower edge to the inner periphery of the flange 50 and spaced inwardly from the upper head lower periphery 26A. The upper edge of the dam upstanding wall 52 is spaced from the lower edge of the baffle side wall 42B about the same distance between the wall 52 and the upper head lower periphery 26A.

Upper and lower annular gaskets 54, 56 are disposed above and below the outer periphery of the flange 50 to seal the connection. The lower gasket 56 spaces the flange 50 above the top surface of the upper tube sheet 18. A series of circumferentially spaced orifices 58 are formed through the portion of the flange 50 defining the bottom of the reservoir 46 to permit draining of the reservoir during periods of non-use.

In a further one of the improved features seen in FIGS. 1 and 2, the liquid distribution arrangement 12 includes a plurality of tubular vent members 60 extending between and interconnecting the baffle 42 and the upper head 26. The vent members 60 provide flow communication between the exterior of the upper head 26, and thus the exterior of the heat exchanger 10, and a region 62 of the top cavity 30 beneath the baffle 42 and above the open tube ends 16B to equalize pressures.

Finally, in yet another of the improved features shown in FIGS. 2–5, the liquid distribution arrangement 12 includes a plurality of liquid flow restricting devices 64. Each device 64 has lower and upper portions 64A, 64B. The lower portion 64A of each device 64 is inserted within one of the open tube ends 16B and has means for causing a helical or swirling rotation of the liquid as it flows into the one open tube end to produce the flowing film F of liquid through the tube 16 on the interior wall surface thereof. Such flow restricting devices have been used in heat exchangers in the past.

Figure 7:
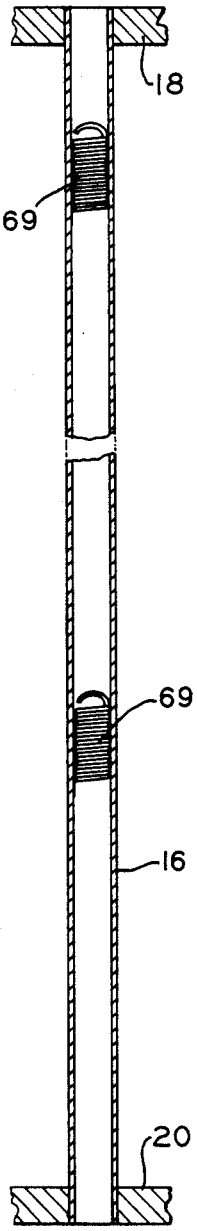
FIG. 7 is a longitudinal sectional view of one of the heat transfer tubes.

More particularly, the lower portion 64A of each flow restricting device 64 includes a plurality of circumferentially spaced spirally configured ribs 66 (which extend through about 90°) defining a plurality of spirally configured flow grooves or passages 68 for restricting the flow of liquid into the open tube end 16B. The restriction of the liquid flow causes a static build-up of a head of liquid within the region 62 of the top cavity 30 beneath the baffle 42. The static head of liquid produces a substantially even distribution of liquid flow to each of the open tube ends 16B. With reference to FIG. 7, a pair of springs 69 may be inserted into tubes 16 and frictionally held in place for the purpose of improving the tendency of the liquid to adhere to the inner walls of tubes 16 as it flows downwardly. Springs 69 are approximately 4 inches in length and may be spaced 9 inches and 40 inches, respectively, from the tops of heat exchange tubes 16.

Figure 8:
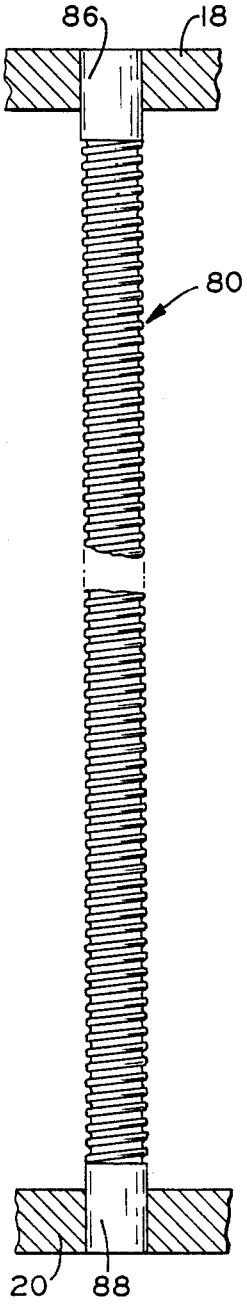
FIG. 8 is an elevational view of a modified form of the heat exchange tube.
Figure 9:
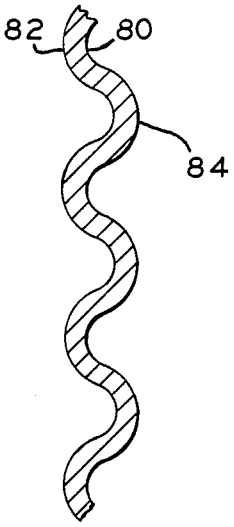
FIG. 9 is an enlarged sectional view of the wall of the fluted tube shown in FIG. 8.

As an alternative to utilizing springs 69, the tubes 80 can be provided with spiral flutes both on the inner surface 82 and outer surface 84 as shown in FIGS. 8 and 9. The spiral flutes can have a 0.12 inch pitch, for example. To facilitate fastening of the ends of tube 80 to tube sheets 18 and 20, the end portions 86 and 88 are preferably smooth.

The spiral fluting on the interior 82 of tubes 80 enhances the tendency of the liquid to adhere to the inner walls 82 and also provides for more uniform distribution of the liquid film. A further advantage of the external fluting is an enhancement in the heat transfer coefficient because the discontinuities provided by the fluting tend to create a large number of nucleation sites. These additional nucleation sites are particularly advantageous at the lower ends of the tubes where wall superheats are relatively small. The fluting can be provided at the upper and lower ends of tube 80 with the center portion of the tube plain and unfluted. Alternatively, the entire tube 80 can be fluted.

The upper portion 64B of each device 64 extends upwardly from the one open tube end 16B to above the level of the dam 48 and into the region 62 of the top cavity 30 located beneath the baffle 42. Also, the upper portion 64B has a central passage 70 which vents the heat exchange tubes 16.

Also, each flow restricting device 64 has a plurality of radially outwardly projecting shoulders 72 at the location of merger of the lower and upper portions thereof 64A, 64B. The shoulders 72 of each device 64, as seen in FIGS. 2 and 5, rest on the portion of the upper tube sheet 18 surrounding the open tube end 16B for supporting the device 64 with its lower portion 64A inserted therein.

In operation, liquid enters upper chamber 30 through inlet 34 and impinges on baffle 42 whereupon it flows radially outwardly between support legs 44 and down into the annular reservoir 46. As reservoir 46 fills to the top, liquid will spill inwardly over the top edge of dam 48 and flood the upper surface of tube sheet 18 with a substantially uniform film of liquid.

The liquid then drains downwardly through flow restriction inserts 66, and the swirling motion imparted to the liquid causes it to adhere to the inner walls of heat transfer tubes 16. As mentioned earlier, springs 69 further assist in maintaining this thin film of liquid. The liquid runs down the tubes and gives up heat to the refrigerant going through the heat exchanger, collects in chamber 32 and then flows outwardly through outlet 38. Hollow flow restriction devices 64 and vents 60 vent the heat exchanger so that free flow of the liquid can occur.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. In a heat exchanger having an upper generally horizontal tube sheet, a multiplicity of generally vertical heat transfer tubes having inner and outer wall surfaces attached at their open upper ends to said upper tube sheet, and an upper head having an inlet spaced above said upper tube sheet, said upper head attached to said upper tube sheet to define a cavity therewith which communicates between said inlet and said ends of said tubes opening above said upper tube sheet so as to allow flow of liquid from said inlet downwardly through said cavity to said open ends of said vertical tubes to flow along the inner surfaces of said tubes, a liquid distribution arrangement comprising:

a baffle;

a dam around the periphery of said upper tube sheet; and means for supporting said baffle in said cavity below said inlet and above said open ends of said tubes; said baffle having means for receiving flow of liquid from said inlet and substantially evenly diverting the liquid flow radially outward to an annular interior perimeter region between said dam and a wall of said upper head, said dam and annular interior region surrounding said open ends of said tubes so that the liquid then flows over said dam and inward to said open tube ends such that the liquid is prevented from flowing directly downwardly through said cavity from said inlet to said open tube ends.

2. The heat exchanger as recited in claim 1, wherein said flow receiving and diverting means of said baffle is a top wall and a side wall depending from an outer periphery of said top wall.

3. The heat exchanger as recited in claim 2, wherein said top and side walls of said baffle have a frusto-conical shape in axial cross-section.

4. The heat exchanger as recited in claim 1, wherein said baffle supporting means includes a plurality of support legs extending between and interconnecting said baffle and said inlet of said upper head.

5. The heat exchanger as recited in claim 1, wherein the inner wall surfaces of said tubes are fluted.

6. The heat exchanger as recited in claim 5, wherein the outer wall surfaces of said tubes are fluted.

7. The heat exchanger as recited in claim 1, wherein the inner wall surfaces of said tubes are spirally fluted.

8. In a heat exchanger having an upper generally horizontal tube sheet, a multiplicity of generally vertical heat transfer tubes having inner and outer wall surfaces attached at their open upper ends to said upper tube sheet, and an upper head having an inlet spaced above said upper tube sheet, said upper head attached to said upper tube sheet to define a cavity therewith which communicates between said inlet and said ends of said tubes opening above said upper tube sheet so as to allow flow of liquid from said inlet downwardly through said cavity to said open ends of said vertical tubes to flow along the inner surfaces of said tubes, a liquid distribution arrangement comprising:

a baffle; and means for supporting said baffle in said cavity below said inlet and above said open ends of said tubes, said baffle supporting means including a plurality of vent members extending between and interconnecting said baffle and said upper head and providing flow communication between the exterior of said upper head and a region of said cavity beneath said baffle and above said open tube ends to vent said cavity;

said baffle having means for receiving flow of liquid from said inlet and substantially evenly diverting the liquid flow radially outward to an annular interior perimeter region of said upper head surrounding said open ends of said tubes from which the liquid can then flow inward to said open tube ends such that the liquid is prevented from flowing directly downwardly through said cavity from said inlet to said open tube ends.

9. The heat exchanger as recited in claim 8, further comprising: a plurality of liquid flow restricting devices, each device having lower and upper portions, said lower portion inserted within one of said open tube ends and having means for causing a swirling rotation of the liquid as it flows into said one open tube end to produce a flowing film of liquid through said tube on an interior wall surface thereof, said upper portion extending upwardly from said one open tube end and into a region of said cavity located beneath said baffle and having a passage which vents said one tube.

10. The heat exchanger as recited in claim 9, wherein said lower portion of each flow restricting device includes a plurality of circumferentially spaced spirally configured ribs defining a plurality of spirally configured flow passages for restricting the flow of liquid into said open tube end so as to cause a static build up of a head of liquid within said region of said cavity beneath said baffle and thereby producing a substantially even distribution of liquid flow to each of said open tube ends.

11. The heat exchanger as recited in claim 9, wherein said each flow restricting device has a plurality of radially outwardly projecting shoulders at a location of merger of said lower and upper portions thereof which rest on a portion of said upper tube sheet surrounding said open tube end for supporting said device with its lower portion inserted therein.

12. In a heat exchanger having an upper generally horizontal tube sheet, a multiplicity of generally vertical heat transfer tubes having inner and outer wall surfaces attached at their open upper ends to said upper tube sheet, and an upper head having an inlet spaced above said upper tube sheet, said upper head attached to said upper tube sheet to define a cavity therewith which communicates between said inlet and said ends of said tubes opening above said upper tube sheet so as to allow flow of liquid from said inlet downwardly through said cavity to at least one of said open ends of said vertical tubes to flow along the inner surfaces of said tubes, a liquid distribution arrangement comprising:

a baffle;

a plurality of liquid flow restricting devices, each device having lower and upper portions, said lower portion inserted within one of said open tube ends and having means for causing a swirling rotation of the liquid as it flows into said one open tube end to produce a flowing film of liquid through said tube on an interior wall surface thereof, said upper portion extending upwardly from said one open tube end and into a region of said cavity located beneath said baffle and having a passage which vents said one tube; and means for supporting said baffle in said cavity below said inlet and above said open ends of said tubes; said baffle having means for receiving flow of liquid from said inlet and substantially evenly diverting the liquid flow radially outward to an annular interior perimeter region of said upper head surrounding said open ends of said tubes from which the liquid can then flow inward to said open tube ends such that the liquid is prevented from flowing directly downwardly through said cavity from said inlet to said open tube ends, said baffle supporting means including a plurality of vent members extending between and interconnecting said baffle and said upper head and providing flow communication between the exterior of said upper head and said region of said cavity beneath said baffle and above said open tube ends to vent the region beneath said baffle.

13. In a heat exchanger having an upper generally horizontal tube sheet, a multiplicity of generally vertical heat transfer tubes having inner and outer surfaces attached at their open upper ends to said upper tube sheet, and an upper head having an inlet spaced above said upper tube sheet, said upper head attached to said upper tube sheet to define a cavity therewith which communicates between said inlet and said ends of said tubes opening above said upper tube sheet so as to allow flow of liquid from said inlet downwardly through said cavity to said open ends of said vertical tubes, a liquid distribution arrangement comprising:

means disposed in said cavity below said inlet and above said open ends of said tubes for receiving flow of liquid from said inlet and substantially evenly diverting the liquid flow radially outward to an annular interior perimeter region of said upper head surrounding said open ends of said tubes; and means defining a dam spaced inwardly from the periphery of said upper head such that said annular interior perimeter region thereof is located between said dam defining means and said upper head for receiving flow from said liquid flow diverting means and providing an overflow reservoir surrounding the upper open tubes end from which the liquid then evenly flows over said dam defining means and inward to said open tube ends such that the liquid is prevented from flowing unevenly directly downwardly through said cavity from said inlet to said open tube ends.

14. The heat exchanger as recited in claim 13 further comprising means for draining said reservoir.

15. The heat exchanger as recited in claim 14, wherein said draining means includes a series of orifices provided in a bottom of said dam defining means to permit draining of said reservoir during periods of non-use.

16. The heat exchanger as recited in claim 13, wherein said flow diverting means includes a baffle having a top wall and a side wall depending from an outer periphery of said top wall.

17. The heat exchanger as recited in claim 16, wherein said top and side walls of said baffle have a frusto-conical shape in axial cross-section.

18. The heat exchanger as recited in claim 16, wherein said flow diverting means also includes a plurality of legs extending between and interconnecting said baffle and said inlet of said upper head for supporting said baffle in said cavity.

19. The heat exchanger as recited in claim 13, further comprising: a plurality of liquid flow restricting devices, each device having lower and upper portions, said lower portion inserted within one of said open tube ends and having means for causing a swirling rotation of the liquid as it flows into said one open tube end to produce a flowing film of liquid through said tube on an interior wall surface thereof, said upper portion extending upwardly from said one open tube end and into a region of said cavity located beneath said baffle and having a passage which allows any gases released by the liquid within said tube to be exhausted therefrom.

20. The heat exchanger as recited in claim 19, wherein said lower portion of each flow restricting device includes a plurality of circumferentially spaced spirally configured ribs defining a plurality of spirally configured flow passages for restricting the flow of liquid into said open tube end so as to cause a static build-up of a head of liquid within said region of said cavity beneath said baffle and inwardly of said dam defining means and thereby producing a substantially even distribution of liquid flow to each of said open tube ends.

21. The heat exchanger as recited in claim 19, wherein said each flow restricting device has a plurality of radially outwardly projecting shoulders at a location of merger of said lower and upper portions thereof which rest on a portion of said upper tube sheet surrounding said open tube end for supporting said device with its lower portion inserted therein.

22. The heat exchanger of claim 13 including barrier means in each of said tubes spaced downwardly from the open ends of said tubes for partially blocking the flow of liquid.

23. The heat exchanger of claim 22 wherein said barrier means comprises a spiral spring member in contact with the inner wall of the respective tube.

24. The heat exchanger of claim 22 wherein said barrier means comprises spiral flutes on the inner wall surfaces of said tubes.

25. The heat exchanger of claim 13 wherein the inner wall surfaces of said tubes are fluted.

26. The heat exchanger of claim 25 wherein the outer wall surfaces of said tubes are fluted.

27. The heat exchanger of claim 13 wherein the inner wall surfaces of said tubes are spirally fluted.

28. In a heat exchanger having an upper generally horizontal tube sheet, a multiplicity of generally vertical heat transfer tubes having inner and outer surfaces attached at their open upper ends to said upper tube sheet, and an upper head having an inlet spaced above said upper tube sheet, said upper head attached to said upper tube sheet to define a cavity therewith which communicates between said inlet and said ends of said tubes opening above said upper tube sheet so as to allow flow of liquid from said inlet downwardly through said cavity to said open ends of said vertical tubes, a liquid distribution arrangement comprising:

means disposed in said cavity below said inlet and above said open ends of said tubes for receiving flow of liquid from said inlet and substantially evenly diverting the liquid flow radially outward to an annular interior perimeter region of said upper head surrounding said open ends of said tubes; and means defining a dam spaced inwardly from the periphery of said upper head such that said annular interior perimeter region thereof is located between said dam defining means and said upper head for receiving flow from said liquid flow diverting means and providing an overflow reservoir surrounding the upper open tubes end from which the liquid then evenly flows over said dam defining means and inward to said open tube ends such that the liquid is prevented from flowing unevenly directly downwardly through said cavity from said inlet to said open tube ends;

said dam defining means including an annular generally horizontal flange extending outwardly and defining a bottom of said reservoir and being connected at its outer periphery to peripheries of said upper head and said tube sheet;

said dam defining means including an upstanding annular wall being attached at its lower edge to an inner periphery of said flange and spaced inwardly from said upper head.

29. The heat exchanger of claim 28, further comprising:

means defining a series of circumferentially spaced orifices through said flange to permit draining of said reservoir during periods of non-use.

30. In a heat exchanger having an upper generally horizontal tube sheet, a multiplicity of generally vertical heat transfer tubes having inner and outer surfaces attached at their open upper ends to said upper tube sheet, and an upper head having an inlet spaced above said upper tube sheet, said upper head attached to said upper tube sheet to define a cavity therewith which communicates between said inlet and said ends of said tubes opening above said upper tube sheet so as to allow flow of liquid from said inlet downwardly through said cavity to said open ends of said vertical tubes, a liquid distribution arrangement comprising:

means disposed in said cavity below said inlet and above said open ends of said tubes for receiving flow of liquid from said inlet and substnatialy evenly diverting the liquid flow radially outward to an annular interior perimeter region of said upper head surrounding said open ends of said tubes, said flow diverting means including a baffle having a top wall and a side wall depending from an outer periphery of said top wall;

a plurality of vent members extending between and interconnecting said baffle and said upper head and providing flow communication between the exterior of said upper head and a region of said cavity beneath said baffle and above said open tube ends; and means defining a dam spaced inwardly from the periphery of said upper head such that said annular interior perimeter region thereof is located between said dam defining means and said upper head for receiving flow from said liquid flow diverting means and providing an overflow reservoir surrounding the upper open tube ends from which the liquid then evenly flows over said dam defining means and inward to said open tube ends such that the liquid is prevented from flowing unevenly directly downwardly through said cavity from said inlet to said open tube ends.

* * * * *